US005876825A

United States Patent [19]

Daley

[11] Patent Number: 5,876,825

[45] Date of Patent: Mar. 2, 1999

[54] CUSTOMIZED CUSHIONED FLOOR MAT AND METHOD OF PRODUCING SAME

[75] Inventor: Scott G. Daley, Ventura, Calif.

[73] Assignee: Pacific Foam Technologies, Ventura, Calif.

[21] Appl. No.: 790,831

[22] Filed: Jan. 28, 1997

[51] Int. Cl.[6] ..... B44C 1/26

[52] U.S. Cl. ..... 428/67; 428/913.3; 442/148

[58] Field of Search ..... 428/67, 913.3; 442/148

[56] References Cited

U.S. PATENT DOCUMENTS

| | | | |
|---|---|---|---|
| 3,065,559 | 11/1962 | McKenzie | 428/67 |
| 3,424,715 | 1/1969 | Brantingham et al. . | |
| 3,576,689 | 4/1971 | Uraushihara | 428/67 |
| 3,660,211 | 5/1972 | Brody | 428/67 |
| 3,695,382 | 10/1972 | Brody | 428/67 |
| 3,749,629 | 7/1973 | Andrews et al. | 428/67 |
| 3,804,699 | 4/1974 | Johnson . | |
| 3,930,084 | 12/1975 | Shields . | |
| 4,491,894 | 1/1985 | Pitts | 361/212 |
| 4,645,556 | 2/1987 | Waugh et al. | 428/67 |
| 5,169,704 | 12/1992 | Faust et al. . | |
| 5,362,544 | 11/1994 | Reuben . | |
| 5,433,980 | 7/1995 | Auld et al. | 428/67 |
| 5,484,638 | 1/1996 | Crabtree | 428/67 |

*Primary Examiner*—Terrel Morris
*Attorney, Agent, or Firm*—Lyon & Lyon LLP

[57] ABSTRACT

The present invention relates to floor mats, particularly to cushioned floor mats which incorporate a patterned or colored material layer. The present invention comprises a cushioned backing layer of rubber or other thermoplastic elastomer, and a substantially clear top layer of thermoplastic material such as polyvinyl chloride. The present invention further comprises an intermediate substrate layer between the backing and top layers. The intermediate layer preferably comprises a colorful or patterned substrate which is visible through the substantially clear top layer and which provides the mat with an aesthetically pleasing appearance. It is further preferred that the substantially clear top layer be subjected to an abrasive process, such as sand blasting, to render the surface substantially scuff-resistant.

19 Claims, 2 Drawing Sheets

CUSTOMIZED CUSHIONED FLOOR MAT AND METHOD OF PRODUCING SAME

FIELD OF INVENTION

The present invention relates to cushioned floor mats and methods for making them, particularly to a cushioned floor mat which has a customizable aesthetic appearance and a method of customizing such mats.

BACKGROUND

Cushioned floor mats are often used on a hard surface to help reduce the physical stress and fatigue of people standing or walking on the surface for prolonged periods of time. In addition, such floor mats may also protect the underlying floor surface from the wear and tear of traffic passing over it.

Such cushioned floor mats are typically made from a cushioning layer of rubber, foam, or other elastomeric or thermoplastic material. However, plain rubber mats do not appear very attractive, particularly when placed in an environment where decor is important. Some prior art mats have tried to improve this appearance by embedding colored plastic in the mat's top surface or by embossing a pattern into the rubber itself.

Other floor mats have provided somewhat better aesthetic appearance by including a layer of carpeting or elastomeric or thermoplastic tile material on top of the cushioning layer. Typically this additional layer provides a tile or carpet finish to the upper surface of the mat more suitable to a room's design. However, such prior art mats do not allow colorful, delicate patterns, or intricate colors to be selected which coordinate with a room's interior design and decor.

Therefore, a new floor mat is needed, which can incorporate patterned and colored materials and fabrics to coordinate the appearance of the mat with a room's interior decor.

SUMMARY OF THE INVENTION

The present invention comprises a cushioned floor mat which incorporates a patterned or colored material layer allowing the floor mat to be customized. Broadly, the present invention has a cushioned backing layer of rubber or other thermoplastic elastomer, and a substantially clear top layer of thermoplastic material such as polyvinyl chloride. The present floor mat further includes an intermediate layer between the backing and top layers. This intermediate layer preferably comprises a colorful or patterned substrate material visible through the top layer which provides the mat with an aesthetically pleasing appearance.

Preferably, the three layers (backing, intermediate, and top) are fused together under heat and pressure. Because of these manufacturing conditions, a substrate material for the intermediate layer is preferred which the fusing conditions will not adversely affect. Furthermore, the selected material should maintain flexibility during fusing and subsequent use.

It is, therefore, a primary object of the present invention to provide a new cushioned floor mat with a pleasing aesthetic appearance, and a method of producing such mats.

Another object of the present invention is to provide a cushioned floor mat which incorporates a substrate layer having a colorful and/or patterned appearance visible when looking at an assembled mat, and a method of manufacturing such mats.

Other objects and features of the present invention will become apparent from consideration of the following description taken in conjunction with the accompanying drawings.

DETAILED DESCRIPTION OF THE PREFERRED EMBODIMENT

Figure 1:
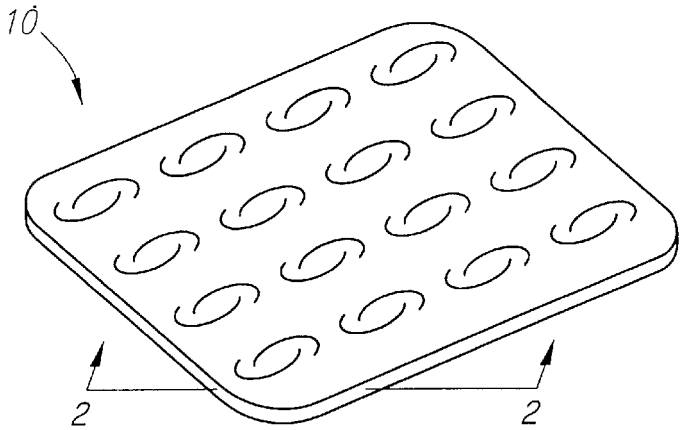
FIG. 1 shows a perspective view of a preferred embodiment of an assembled mat of the present invention.

The present invention comprises a new cushioned floor mat 10, a preferred embodiment of which is shown in FIG. 1. As shown in FIG. 1, the floor mat 10 has a bottom cushioning layer 12, an intermediate substrate layer 14, and a substantially clear top layer 16. The bottom layer 12 provides cushioning and/or resiliency, while the intermediate layer 14 includes a decorative pattern or color. The top layer 16 should be sufficiently clear, rendering the pattern or color on the intermediate substrate layer 14 visible through it.

For the bottom cushioning layer 12, an elastomeric material, such as rubber, is preferred which is both resilient and durable. The material is preferably configured in sheet form, having a thickness of about 6 mm to about 25 mm. Griswold Rubber Company, Moosup, CN for example, produces a foam rubber suitable for this bottom layer. Other materials, such as cross-linked polyethylene foams, may also be used.

The intermediate substrate layer 14 preferably comprises fabric, paper, plastic, foam, or similar material with a colorful and/or decorative pattern incorporated onto its top surface 14*a*. This material should be substantially flexible, and should be able to substantially withstand the processing conditions described below without significant adverse effects (i.e. the material should tolerate heat and pressure). In addition, the material of the substrate layer 14 should be compatible with a preferred adhesive such that the adhesive flows substantially evenly on its surface and adheres substantially to it. Although the material of the substrate layer 14 may absorb the adhesive, preferably such absorption will not be substantial (i.e. no more than about 10% of the adhesive should be absorbed by the foam applied to the substrate).

Of the exemplary materials listed, cloth fabric provides superior durability, while maintaining flexibility after being incorporated into a finished mat. Polyesters or synthetic fabrics are preferred, although natural materials could also be used. In addition, cloth fabrics are commercially available in a wide variety of patterns and colors. Thus, the ultimate user of the mat may select a pattern or color most suited to their particular decor. The end user may even be able to provide their own fabric which they have already selected as part of their interior design.

The substantially clear top layer 16 preferably comprises a thermoplastic elastomer which can withstand the processing conditions described in detail below. For ease of handling during production, this material may be obtained in sheets, preferably having a thickness of between about 1/16 inch and 1/4 inch, with 3/32 inch thickness being most preferred. The material is sufficiently transparent or translucent to enable the pattern or color on the underlying intermediate layer 14 of the assembled floor mat 10 to show through. The preferred material should also be treatable to render the top surface 16*a* of the material substantially scuff-resistant, thus allowing people to walk on the top surface 16*a* without marring the aesthetic appearance of the intermediate layer 14 showing through.

Although polyvinyl chloride (PVC), being both durable and readily available, is preferred for this material, other plastics such as polyester, polyurethane, polycarbonate, polyethylene, PET, or PETG have adequate transparency to work as well. Fabricated Extrusion Co. of Modesto, Calif. manufactures a preferred example of a polyvinyl chloride sheet appropriate for use in the clear top layer 16.

Figure 3:
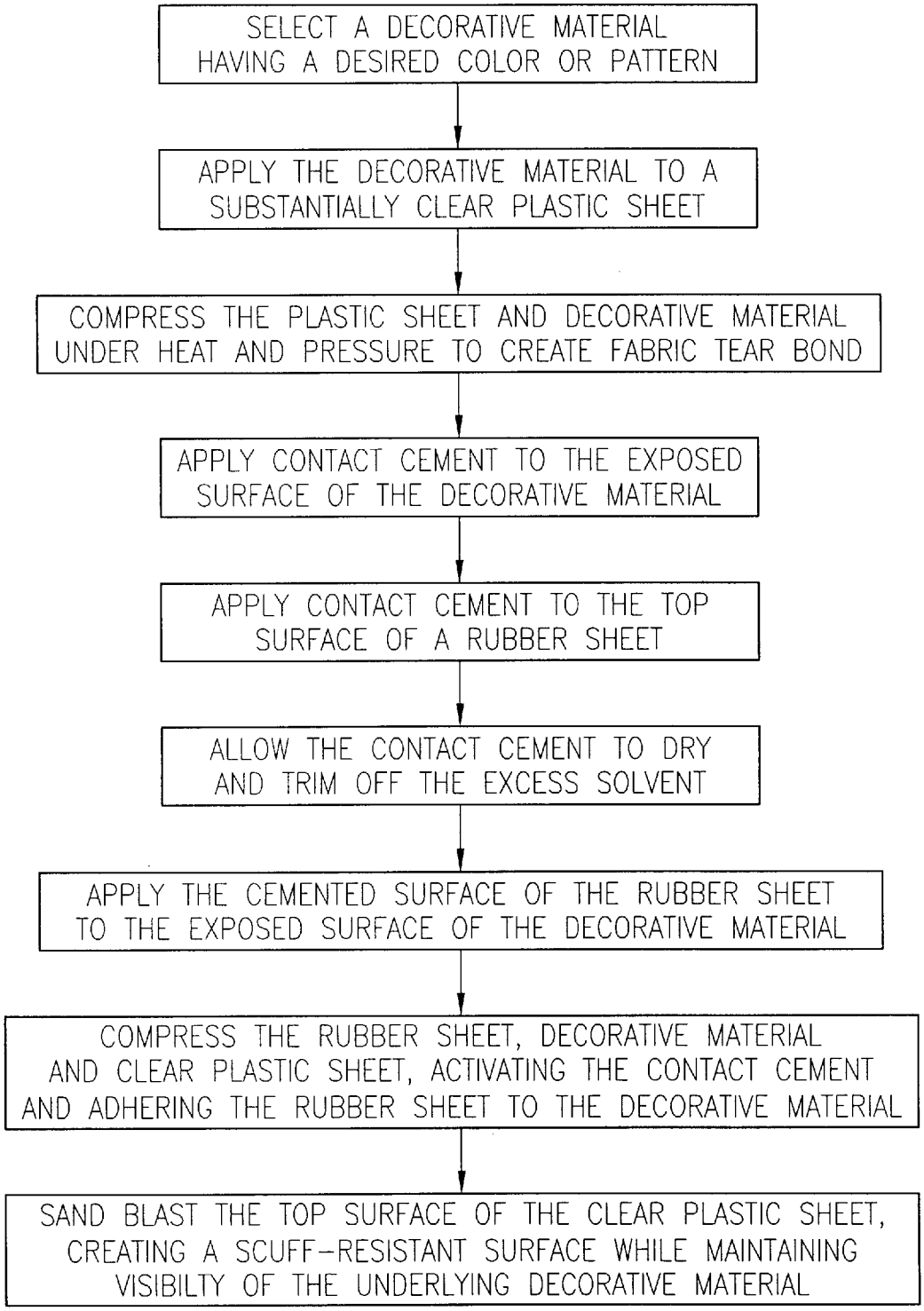
FIG. 3 is a flow diagram of a preferred process of assembling a mat of the present invention.

To produce the finish mat 10, the three layers must be fused together, for example using the method shown in FIG. 3. A preferred method of assembly of a preferred floor mat of the present invention involves first fusing the intermediate layer 14 to the substantially clear top layer 16. The two layers may be fused by applying an adhesive to the patterned or colored top surface 14*a* of the substrate layer 14, laminating the coated substrate to the bottom surface 16*b* of the material for layer 16, and subjecting the laminated structure to pressure and temperature. Preferred adhesives for use in this process include epoxy, polyvinyl acetate, acrylic, or polyurethane, as it has been found that other adhesives, particularly those containing animal products, do not tolerate temperature processing without substantial adverse effects.

In the preferred method, however, the substrate layer 14 and the clear top layer 16 are effectively fused without the need for adhesives. The top layer 16, such as a PVC sheet, and the intermediate layer 14, preferably cloth fabric, are subjected to heat and pressure in a press. This softens the PVC, adhering the fabric to it. Under optimum conditions, this preferred method enables fabric tear bond to occur, wherein the fabric is partially absorbed into the PVC. Fabric tear bond creates the strongest adhesion because of this partial absorption, substantially eliminating the possibility that the two layers will delaminate during the life of the finished mat.

Optimum fabric tear bond has been found to occur when the PVC top layer 16 and fabric intermediate layer 14 are subjected to a temperature of about 155 degrees Fahrenheit under a pressure of about 500 pounds per square centimeter for a time period of approximately 60 seconds. Although temperatures of 200 degrees Fahrenheit or more can be used for shorter periods of time, this increases the risk of curling and bubbling of the PVC, reducing the aesthetic appearance of the finished mat 10. Similarly, the temperature can be reduced, for example down to about 140 degrees Fahrenheit, being offset by greater pressures being applied for longer periods of time. This condition provides good fabric tear bond, but increases distortion as the plastic spreads, creating potentially inconsistent thickness of the top layer 16.

Once the top layer 16 and the intermediate layer 14 are bonded together, the two layer structure 18 is then adhered to the cushioned backing layer 12, preferably using pressure sensitive contact cement. The exposed surface 14*b* of the intermediate layer 14 and the top surface 12*a* of the backing layer 12 are both covered with the contact cement. After the cement has dried, the excess solvent is trimmed off. The two layer structure 18 and the backing layer 12 are then compressed together in a press. This activates the contact cement, effectively bonding the backing layer 12 to the two layer structure 18. Although pressures of about 8 pounds per square inch have been successfully used to press these layers together and create an effective bond, other pressures will probably work effectively as well.

Figure 2A:
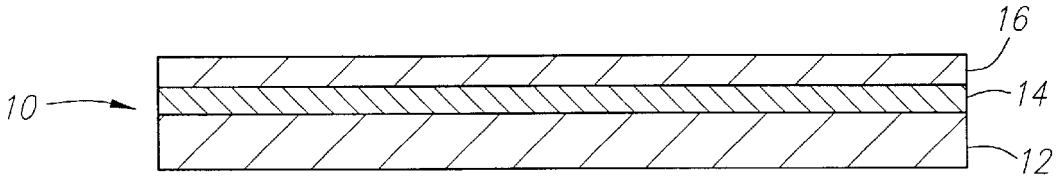
FIG. 2A shows an enlarged cross sectional view of a preferred embodiment of an assembled mat of the present invention taken along line 2—2 as shown in FIG. 1.
Figure 2B:
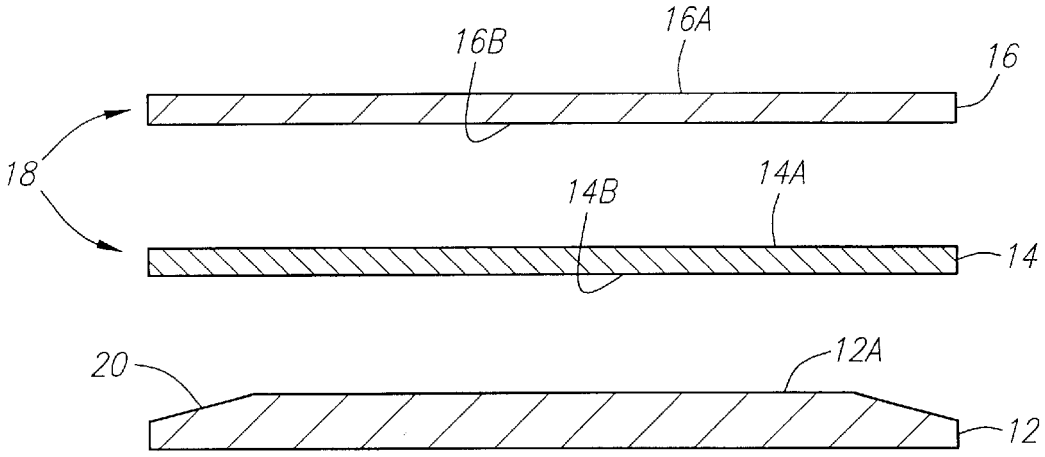
FIG. 2B shows an exploded view of the cross-sectional view of FIG. 2A.

Because of potential problems with the top layer 16 curling, in the preferred embodiment, the top surface 12*a* of the backing layer 14 has a bevel 20, preferably about 2 inches wide, around the edge of the mat (shown in FIG. 2B). When the two layer structure 18 and the backing layer 12 are compressed together, the beveled edge 20 adheres to the bottom surface 14*b* of the intermediate layer 14. This contact keeps the top layer 16 under slight tension, pulling it down towards the backing layer 12, helping to prevent the top layer 16 from curling up.

In the preferred embodiment, the upper exposed surface 16*a* of the top layer 16 is preferably subjected to an abrasive process such as sand blasting. This abrades the top surface 16*a* to make it substantially scuff resistant while maintaining the visibility of the patterning and/or coloring intermediate layer 14 beneath it. The abrasion may also be used to create a slightly rough top surface 16*a* to reduce the chance of slipping on the mat by foot traffic passing over it.

Because this process is compatible with a multitude of materials, the intermediate substrate may contain any customized logo or design desired such that a customized floor mat is obtained.

While an embodiment of the present invention has been shown and described, various modifications may be made without departing from the scope of the present invention, and all such modifications and equivalents are intended to be covered.

I claim:

1. A decorative customized floor mat comprising a substantially clear plastic top layer, an intermediate layer comprising cloth fabric, said intermediate layer being fabric tear bonded to said top layer, and a resilient rubber backing layer, adhesively connected to said intermediate layer.

2. A floor mat, comprising a bottom resilient layer, a decorative intermediate substrate layer, and a substantially clear top layer, wherein the three layers are fused together such that the decorative intermediate substrate is visible through the substantially clear top layer, and wherein the top layer is subjected to an abrasive process which renders the layer substantially scuff resistant.

3. The floor mat of claim 2 wherein the abrasive process is a sand blasting process.

4. A decorative customized floor mat, comprising a substantially clear top layer, an intermediate layer comprising a decorative material bonded to said top layer, and a resilient backing layer, adhesively connected to said intermediate layer, wherein said backing layer comprises a beveled edge adapted to prevent said top layer from curling.

5. A decorative floor mat, comprising a substantially clear top layer, a decorative intermediate layer bonded to the top layer, and a cushioned backing sheet adhered to the intermediate layer, wherein the cushioned backing sheet has a thickness of at least about 6 mm and not more than about 25 mm.

6. The decorative floor mat of claim 5, wherein the cushioned backing sheet comprises an elastomeric foam.

7. The decorative floor mat of claim 5, wherein the intermediate layer comprises fabric.

8. The decorative floor mat of claim 5, wherein the intermediate layer comprises paper.

9. The decorative floor mat of claim 5, wherein the top layer includes a scuff-resistant top surface.

10. The decorative floor mat of claim 5, wherein the backing sheet comprises a beveled edge adapted to prevent the top layer from curling.

11. The decorative floor mat of claim 5, wherein the intermediate layer is bonded to the top layer by an adhesive.

12. The decorative floor mat of claim 5, wherein the cushioned backing layer is adhered to the intermediate layer by an adhesive.

13. A decorative floor mat, comprising a substantially clear top layer, a decorative intermediate layer bonded to the top layer, and a cushioned backing sheet adhered to the intermediate layer, wherein the decorative intermediate layer comprises cloth fabric.

14. The decorative floor mat of claim 13, wherein the cloth fabric includes a pattern or color selected to match a preselected interior design.

15. The decorative floor mat of claim 13, wherein the top layer includes a scuff-resistant top surface.

16. The decorative floor mat of claim 13, wherein the backing sheet comprises a beveled edge adapted to prevent the top layer from curling.

17. The decorative floor mat of claim 13, wherein the intermediate layer is selected to match a preselected decorative pattern of an interior design.

18. The decorative floor mat of claim 13, wherein the intermediate layer is bonded to the top layer by an adhesive.

19. The decorative floor mat of claim 13, wherein the intermediate layer is fabric tear bonded to the top layer.

* * * * *